United States Patent [19]

Hum

[11] Patent Number: 4,918,267

[45] Date of Patent: Apr. 17, 1990

[54] VACUUM OPERATED CIRCUIT BREAKER

[76] Inventor: Anthony Hum, 3185 Ellendale, Apt. 22, Montreal, Quebec, H3S-1W6, Canada

[21] Appl. No.: 339,608

[22] Filed: Apr. 17, 1989

[51] Int. Cl.[4] ..... H01H 35/38

[52] U.S. Cl. ..... 200/82 R; 73/745; 200/81.4; 340/626

[58] Field of Search ..... 340/605, 626; 73/745; 123/146.5 D, 179 BG; 200/82 R, 81.4, 81.5; 307/118

[56] References Cited

U.S. PATENT DOCUMENTS

| | | | |
|---|---|---|---|
| 1,719,049 | 7/1929 | Forsberg | 200/81.5 |
| 4,008,619 | 2/1977 | Alcaide | 73/724 |
| 4,402,224 | 9/1983 | Fukushima | 73/705 |
| 4,616,215 | 10/1986 | Maddalena | 340/626 |
| 4,752,658 | 6/1988 | Mack | 73/745 |

*Primary Examiner*—Gerald P. Tolin
*Attorney, Agent, or Firm*—Richard L. Miller

[57] ABSTRACT

A pair of electrical switches are operable by a movable lever between a first condition where the first switch is on and the second switch is off, to a second condition where the first switch is off and the second switch is on, by movement of a piston connected to a pressure source via an inlet port. A flange is fixed on the piston shaft, and a compressed spring is mounted over the piston shaft between the flange and a sleeve surrounding the piston bore. A pressure close to ambient moves the flange which in turn moves the lever to the first position, while a pressure substantially less than ambient moves the flange in the direction to move the lever to the second position. The switches are adapted to respond to the pressure of the input manifold of a motor vehicle, actuating the vehicle headlight circuit when the motor is running and the manifold pressure is very high, and actuating the starter/ignition circuit when the motor is not running and the manifold pressure is at ambient.

8 Claims, 1 Drawing Sheet

VACUUM OPERATED CIRCUIT BREAKER

BACKGROUND OF THE INVENTION

Field of the Invention

This invention relates to apparatus for turning a pair of electrical switches alternately on and off as a function of the pressure of a pressure source, and particularly to apparatus responsive to the input manifold pressure of a motor vehicle engine for controlling the operation of the starter/ignition and the headlight circuits. A pressure responsive piston with a flange connected to the piston shaft actuates a lever which controls the electrical switches.

Description of the Prior Art

Pressure responsive switches in which an electrical switch or contact, or a plurality of switches, are turned on or off in response to a pressure are useful in numerous applications. For example, U.S. Pat. No. 4,616,215 to Maddalena shows a transducer for sensing a vacuum level and producing alarm signals if the pressure is too high or too low. U.S. Pat. No. 4,402,224 to Fukushima shows a device for monitoring vacuum pressure comprising an electric field generator and detector involving a light source and photo detector eventually producing an electrical signal. U.S. Pat. No. 4,008,619 to Alcaide et al measures pressure changes by movement of a diaphragm to change capacitance levels. These approaches to pressure sensing, particularly of vacuum pressures, while useful, are complex and expensive.

Less complex and expensive vacuum pressure sensors which produce switching of electrical circuits are found in U.S. Pat. No. 1,719,049 which shows an ignition switch for automobile engines in which cranking of the engine to start the engine produces a partial vacuum in the manifold which moves a diaphragm to close electrical contacts and complete the ignition circuit. Canadian Pat. No. 210016 measures air pressure from a ventilating system by moving a piston in response to the pressure, and electrical contact pins attached to the piston shaft physically close electrical circuits when the piston is moved to extreme positions to indicate pressures that are too high or too low. IBM Technical Disclosure Bulletin entitled Multiconfiguration Pressure Switch, Volume 8, Number 7, December 1965, shows a pressure switch with a piston movable in response to a pressure, the piston operating a magnet to open or close reed switches positioned adjacent to the path of travel of the magnet, one of the switches being normally open and the other normally closed.

SUMMARY OF THE INVENTION

The present invention is an improvement over the prior art and provides a novel and inexpensive pressure operated piston device connected to a source of pressure which varies between ambient pressure and a high vacuum pressure, such as at the intake manifold of an automobile engine. The piston has a flange attached to its shaft, and a lever is moved by the flange to alternately open and close two switches. One switch may be in the ignition circuit of the engine to permit operation of the engine starter when the pressure is at ambient, indicating that the engine is not running, and the other switch may be in the headlight circuit to permit operation of the headlights only when the manifold pressure is at vacuum levels indicating that the engine is running.

It is therefore an object of the present invention to provide a simple and inexpensive pressure operated switch mechanism which alternately opens and closes a pair of electrical switches in response to sensed pressures which vary between ambient and vacuum levels.

Another object of the present invention is a vacuum operated circuit breaker in which an adjustable spring biases a piston to its limit in one direction when the sensed pressure is at ambient, and in which adjustment of the spring compression provides an adjustable time delay in the time it takes the piston to move from the limit position when a vacuum is sensed to the limit position as when the sensed pressure increases to ambient.

A further object of this invention is a vacuum operated circuit breaker having an adjustable bleed into the piston bore to further vary the rate at which the pressure in the bore changes and the piston moves between its limit positions.

A still further object of this invention is a novel vacuum operated circuit breaker in which a lever operable between two switch position in response to movement of a piston is spring biased to one of the two positions to turn one switch on and the other switch off during the time when a pressure less than ambient is encountered.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DESCRIPTION OF THE PREFERRED EMBODIMENTS

Figure 1:
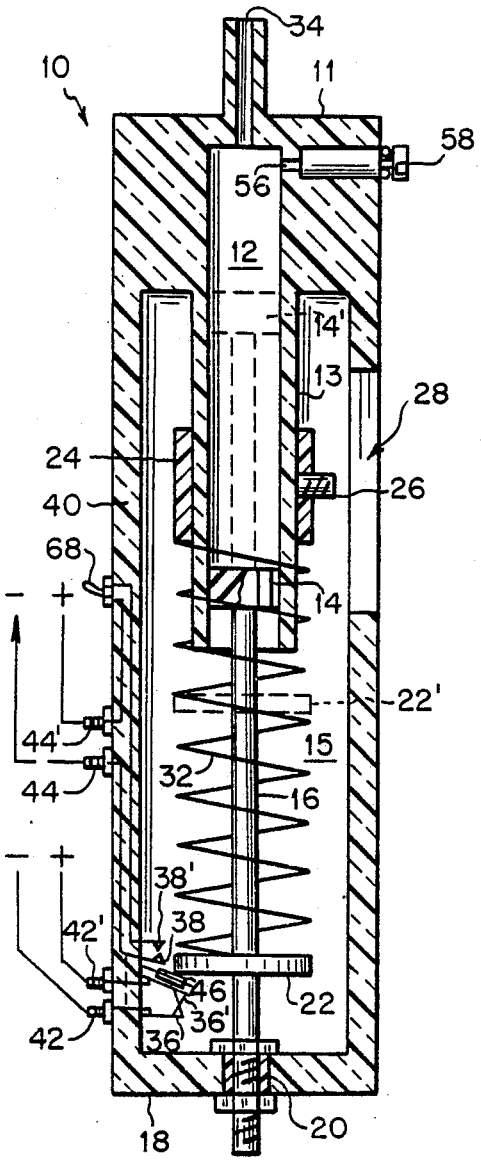
FIG. 1 is a diagrammatic vertical elevational cross sectional view of the invention illustrating the non-vacuum position of the piston in solid lines and the vacuum positioned of the piston in phantom lines.

Referring to FIG. 1 there is shown an enclosure 10, preferably of metal or plastic, containing a bore 12 formed partially from the top wall 11 of the enclosure 10, and partially by a conduit 13 extending from top wall 11. A piston 14 of rubber, or of some other substance such as metal and having a rubberlike sealing ring similar to a piston ring, is positioned for movement along the axis of bore 12. The conduit 13 extends only partially into a chamber 15 formed within enclosure 10.

A shaft 16 is connected at one end to piston 14, and extends through the bottom wall 18 of enclosure 10. A bushing 20 may be located in the bottom wall 18. Alternatively, a sleeve may be provided inside enclosure 10 to allow for movement of shaft 16. Fixedly attached to shaft 16 is a projecting ring or flange 22.

Surrounding conduit 13 is a sleeve 24 which is movable vertically along the outside of the conduit 13, and which may be secured thereto at any position along the length of the conduit by a screw 26 threaded through sleeve 24. An opening 28 in the sidewall 40 of enclosure 10 permits easy access to screw 26 for adjusting the vertical position of sleeve 24.

A compression spring 32 is fixed about shaft 16 and secured at each end in grooves, not shown, in the bottom of sleeve 24 and in the top of flange 22. Bore 12 is open via inlet port 34 to a pressure source such as the inlet manifold of an internal combustion engine used in a motor vehicle where the pressure varies between ambient when the engine is not running, to an essentially vacuum condition when the engine is running. When the pressure in bore 12, which is open to the pressure source, is at ambient, there is no pressure differential between the top and bottom of piston 14, and spring 32 pushes flange 22 and piston 14 downward as shown in FIG. 1. This downward movement is referred to as the compression stroke. When the pressure sensed in bore 12 is reduced or near vacuum such as the pressure produced in the engine intake manifold during operation of the engine, the pressure at the bottom of piston 14 is at ambient, and the pressure differential across the piston 14 pushes it and flange 22 to the positions 14' and 22' shown in phantom in FIG. 1.

Figure 5:
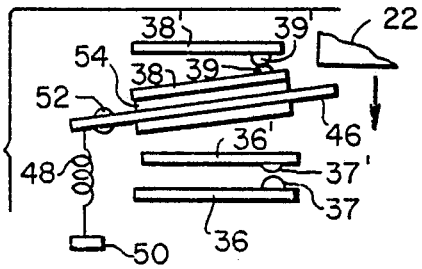

As shown in FIGS. 1 and 5, two pairs of flexible electrical contact rods 36, 36' with contact points 37, 37' and contact rods 38, 38' having contact points 39, 39' are connected respectively through sidewall 40 of enclosure 10 to electrical terminals 42, 42' and 44, 44'. A source of electrical voltage is applied to the terminals 42, 42', 44, 44' as shown in FIG. 1. Insulating bushings and washers, not shown, may be required to electrically insulate the terminals and contact rods from sidewall 40.

A movable lever 46 is mounted on the inside of side wall 40 and extends into compartment 15 in the path of flange 22. When the pressure of the source sensed in bore 12 is at ambient, flange 22 will be in its lowest position as shown in FIG. 1, and the bottom of the flange 22 will physically contact and push lever 46 downward, forcing point 37' of rod 36' into physical contact with point 37 of rod 36, thus permitting the flow of electrical current through terminals 42, 42'.

FIG. 5 shows the action of lever 46 in detail. When a vacuum or a pressure substantially less than ambient is in bore 12, flange 22 moves upward and is not in contact with lever 46. Contact rods 36, 36' separate and current no longer flows through terminals 42,42'. A spring 48 is connected between a fixed point 50, such as in bottom was 18 of enclosure 10, and the end of lever 46. This causes lever 46 to rotate about a pivot 52, forcing contact rod 38 upward and point 39 into physical contact with point 39'. Current then flows through terminals 44,44'. Raised elements 54,54' may be glued or otherwise attached respectively to the top and bottom surfaces of lever 46 to provide optimum leverage to contact rods 36' and then 38 when lever 46 rotates about pivot 52.

It is preferred that for use in automotive circuits as will be described, one set of contact points will close immediately after the other set of points is opened. However, in other applications the contact rods may be positioned such that neither set is closed for selected positions of flange 22. And it is within the scope of this invention to provide a plurality of switches responsive to the position of the flange 22.

Figure 4:
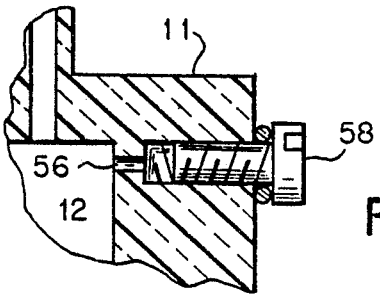
FIG. 4 is an enlarged fragmentary view of the bleed valve shown in FIG. 1; and, FIG. 5 is an enlarged fragmentary view of the electrical contacts shown in FIG. 1.

As shown in FIG. 1 and in greater detail in FIG. 4, a bleed passage 56 connects bore 12 with outside ambient pressure. A screw 58 may be adjusted to vary the rate at which ambient air is fed from the outside through passage 56 and into bore 12, and thus acts as a bias to the rate at which the pressure in bore 12 varies and the rate at which piston 14 moves in response to pressure changes.

Figure 2:
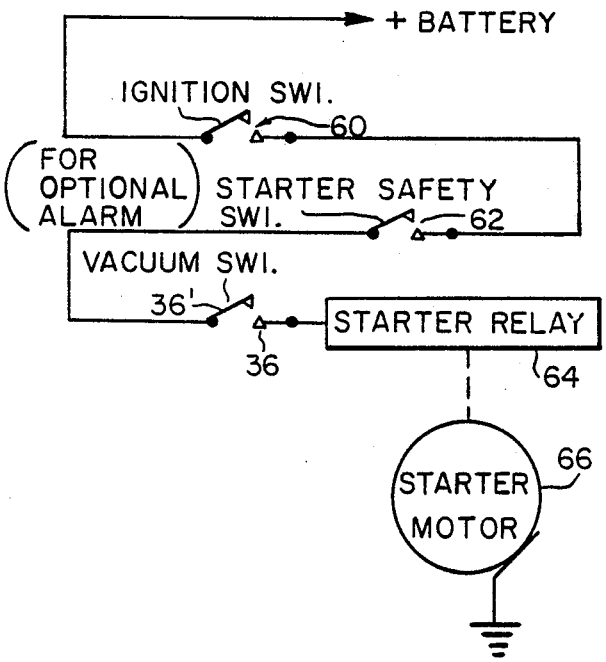
FIG. 2 is a schematic diagram of the instant invention connected for an automobile starter circuit only.

FIG. 2 shows schematically how the switch formed by contact rods 36,36', which is in effect an on-off switch, may be used to enable or disable the starter circuit in a motor vehicle. When the engine is not operative, bore 12 senses ambient pressure and spring 32 forces flange 22 against the top of lever 46 to force contact rod 36 against rod 36' as shown in FIG. 1, and the circuit formed between terminals 42, 42' is closed. When ignition switch 60, FIG. 2, is closed such as by inserting and turning the ignition key in the vehicle, and when optional vehicle alarm system switch 62 is closed, then contact between points 37,37' of rods 36,36' will close the circuit between the vehicle battery and starter relay 64, and starter motor 66 will be actuated. When the engine is running, the pressure sensed in bore 12 is substantially less than ambient, piston 14 and flange 22 will be in the phantom positions 14',22' shown in FIG. 1, rods 36,36' will be physically separated and no current can flow from the battery to the starter relay 64.

Figure 3:
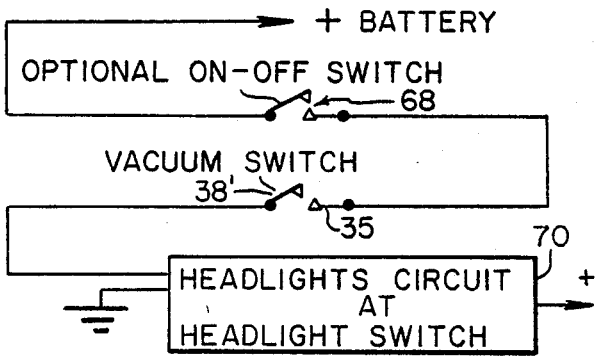
FIG. 3 is a schematic diagram, of the instant invention connected in an automobile headlight circuit only.

FIG. 3 shows schematically how the on-off switch formed by rods 38,38' may be used to enable or disable the headlight circuit in a motor vehicle automatically. When the engine is operating, bore 12 senses a vacuum condition or a pressure substantially less than ambient, points 39,39' of rods 38,38' are touching and current may flow through terminals 44,44'. In FIG. 3, if optional switch 68, is illustrated which will disable the automatic headlight circuit so that the head lights may only be manually switched on by the conventional dashboard switch.

Referring again to FIG. 1, sleeve 24 is movable along the outside of conduit 13 to control the spring tension of spring 32, and thus the time of the compression stroke, i.e. the time for the piston 14 to move from its position shown at 14' to its position shown at 14, which movement occurs when the engine is turned off. Sliding the sleeve 24 upward will reduce the spring tension, in which case the compression stroke will require a longer time. Sliding the sleeve 24 downward will increase the spring tension and the compression stroke will require less time. The spring tension is selected to provide a maximum time of 15 seconds and a minimum time of 5 seconds. The rate of movement of piston 14 may also be varied by adjusting screw 58 to vary the bleed air into bore 12.

The time delay adjustment is desirable to compensate for the loss in manifold vacuum when the accelerator pedal is pushed all the way down and the engine accelerates rapidly. During this period there remains a small amount of vacuum suction from the inlet manifold to bore 12 which will retard the compression spring stroke. Adjustment of sleeve 24 and/or screw 58 are useful to adjust the compression stroke timing.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A vacuum operated switch comprising:

(a) an enclosure open to ambient pressure and having a side wall and opposed end walls, with a conduit defining a cylindrical bore and having an axis located in said enclosure and extending from one said end wall of said enclosure and terminating short of the opposite end wall of said enclosure;

(b) a piston within said bore and movable along said axis;

(c) a shaft connected at one end to said piston and extending beyond the end of said conduit and through a bushing within the said opposite end wall;

(d) a flange member fixedly connected on said shaft between the end of said conduit and said opposite end wall and movable along the said axis in response to movement of said piston;

(e) a sleeve member mounted on said conduit;

(f) a compression spring surrounding said shaft and extending between said sleeve member and said flange member, said spring being adapted to force said piston and said flange member along said axis toward said opposite end wall;

(g) an inlet port in said one end wall connecting said cylindrical bore with said pressure source whereby a pressure substantially less than ambient will cause said piston and said flange member to move within said bore toward said one end wall;

(h) first and second electrical switch means connected with said enclosure and operable between on and off states; and, (i) movable lever means connected with said enclosure and having one end extending within the path of movement of said flange member, said lever means being operable in response to movement of said flange member, said lever means being operable in response to movement of said flange member so as to close said first electrical switch and open said second electrical switch when the pressure of said pressure source is substantially at ambient pressure and said flange member is moved by said compression spring toward said opposite end wall, and operable so as to open said first electrical switch and close said pressure source to substantially below ambient pressure and said flange member is moved away from said opposite end wall.

2. A vacuum operated switch as in claim 1 in which each of said first and second electrical switch means comprises a pair of flexible, vertically spaced, electrically conductive contacts extending from the side wall of said enclosure, said lever means being located between said first and second pairs of contacts and movable so that movement of said lever means in one direction will produce physical contact between one of said pair of contacts, and movement of said lever means in the opposite direction will open said one pair on contacts and produce physical contact between the other of said pair of contacts.

3. A vacuum operated switch as in claim 2 further including a second spring for biasing said lever means in a direction to maintain contact between a first one of said pair of contacts, movement of said flange member in response to said compression spring forcing said lever means in a direction to break said contact between said first one of said pair of contacts and causing contact between the other said pair of contacts.

4. A vacuum operated switch as in claim 2 and including an electrical terminal connected with each or said conductive contacts and located in a wall of said enclosure, said terminals being adapted to conduct an electrical current therethrough upon physical contact between said contacts.

5. A vacuum operated switch as in claim 1 in which said sleeve member is movable along said conduit for varying the tension of said compression spring and for adjusting the rate of movement of said piston along said axis upon changes in the pressure of said pressure source.

6. A vacuum operated switch as in claim 1 and including a bleed passage in said enclosure connecting said cylindrical bore with outside ambient pressure, and adjustable screw means for adjusting the rate of air flow through said bleed passage.

7. A vacuum operated switch as in claim 1 in which said first switch means is connected in the starter circuit of a motor vehicle.

8. A vacuum operated switch as in claim 1 in which said second switch means is connected in the headlight circuit of a motor vehicle.

* * * * *